US007380686B1

(12) United States Patent
Friedman et al.

(10) Patent No.: US 7,380,686 B1
(45) Date of Patent: Jun. 3, 2008

(54) UTILITY CASE SYSTEM

(75) Inventors: Brian G. Friedman, Fairlawn, OH (US); Michael A. Doyle, Holland, OH (US)

(73) Assignee: Seavival, LLC, Toledo, OH (US)

( * ) Notice: Subject to any disclaimer, the term of this patent is extended or adjusted under 35 U.S.C. 154(b) by 645 days.

(21) Appl. No.: 11/071,279

(22) Filed: Mar. 3, 2005

(51) Int. Cl.

| | |
|---|---|
| ***B65D 1/24*** | (2006.01) |
| ***B65D 25/28*** | (2006.01) |
| ***B65D 53/02*** | (2006.01) |
| ***B65D 43/22*** | (2006.01) |
| *B65D 25/04* | (2006.01) |
| *B65D 51/04* | (2006.01) |

(52) U.S. Cl. ..... 220/826; 220/520; 220/522; 220/526; 220/318; 220/833

(58) Field of Classification Search ..... 220/520–522, 220/526, 531, 318, 826, 833
See application file for complete search history.

(56) References Cited

U.S. PATENT DOCUMENTS

| | | | | |
|---|---|---|---|---|
| 1,462,245 | A | 7/1923 | Reglein | |
| 1,502,987 | A | 7/1924 | Glass et al. | |
| 2,697,539 | A | 12/1954 | Warner | |
| 3,185,338 | A | 5/1965 | Henning | |
| 3,459,327 | A | 8/1969 | Harris | |
| 3,598,301 | A * | 8/1971 | Shaw et al. | 206/436 |
| 3,747,796 | A | 7/1973 | Kneier et al. | |
| 3,933,296 | A | 1/1976 | Ruskin et al. | |
| 4,285,556 | A * | 8/1981 | Loeffel | 312/244 |
| 4,415,080 | A | 11/1983 | Romine et al. | |
| 4,613,041 | A * | 9/1986 | Carlton | 206/373 |
| 4,779,753 | A * | 10/1988 | Capy | 220/522 |
| 5,035,321 | A | 7/1991 | Denton | |
| 5,082,631 | A * | 1/1992 | Lenmark et al. | 422/102 |
| 5,323,898 | A | 6/1994 | Kester | |
| D355,299 | S | 2/1995 | Lowden | |
| 6,533,138 | B2 | 3/2003 | Chwen-Ru | |
| 6,648,166 | B2 * | 11/2003 | Levy | 220/520 |
| D488,928 | S | 4/2004 | Foley et al. | |
| 6,736,265 | B2 | 5/2004 | Kipper et al. | |

* cited by examiner

*Primary Examiner*—Anthony D. Stashick
*Assistant Examiner*—Niki M. Eloshway
(74) *Attorney, Agent, or Firm*—Shumaker, Loop and Kendrick

(57) ABSTRACT

A case has a center support and an open top. A central wall forms first and second major chambers with an aperture there between. The case has a pair of butterfly doors forming minor chambers. Hinges couple the butterfly doors to the central support adjacent to the top. A sealing assembly is an injection molded, one piece seal formed of first and second sealing rings joined together along an intermediate extent. An annular recess is formed in the case at the open top around each major chamber. The recesses receive and support the sealing rings. Recipient regions are provided in the butterfly doors around the minor chambers for contacting the sealing rings when the butterfly doors are in the closed orientation. A handle assembly has a handle and depending components. The depending components include a projection with keyways. A recipient sleeve supports the projection. The handle assembly has keys in the aperture of the center support.

3 Claims, 6 Drawing Sheets

FIG 1
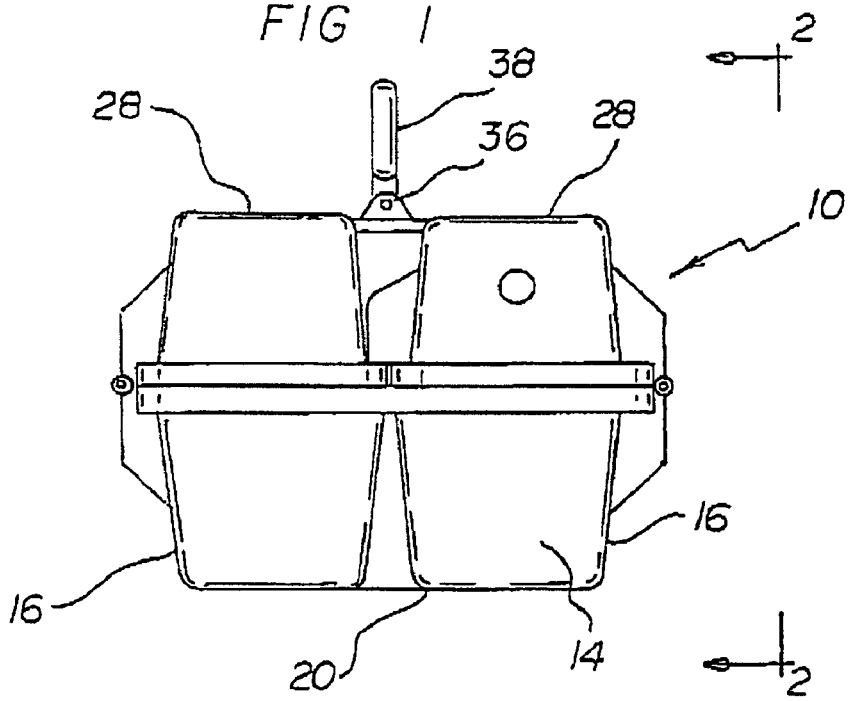
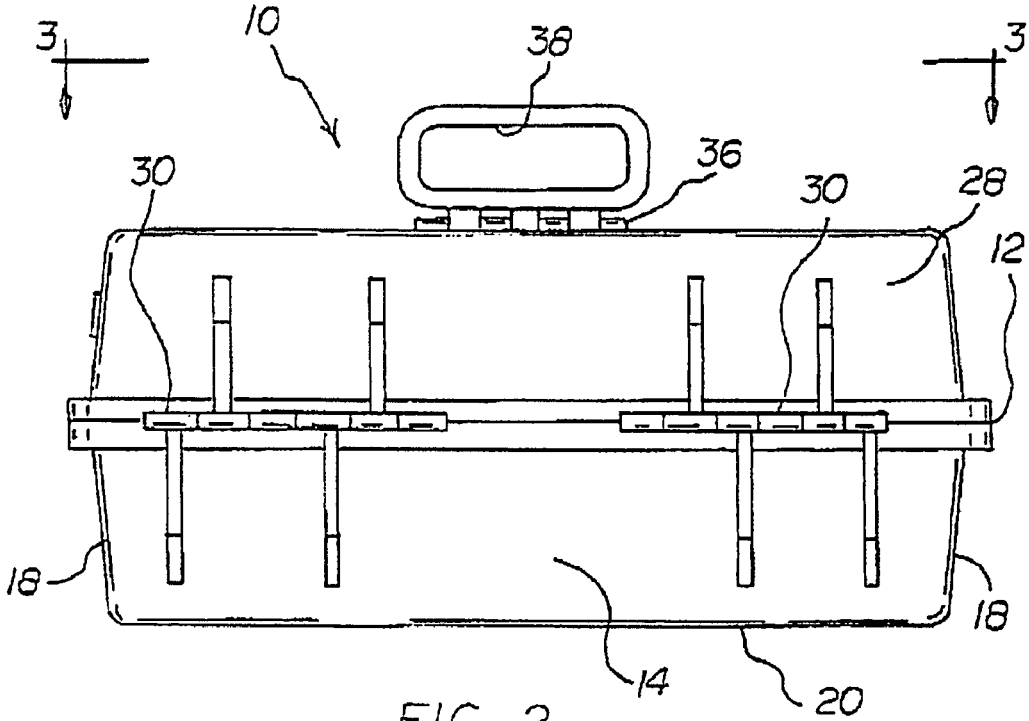
FIG 2

FIG 3
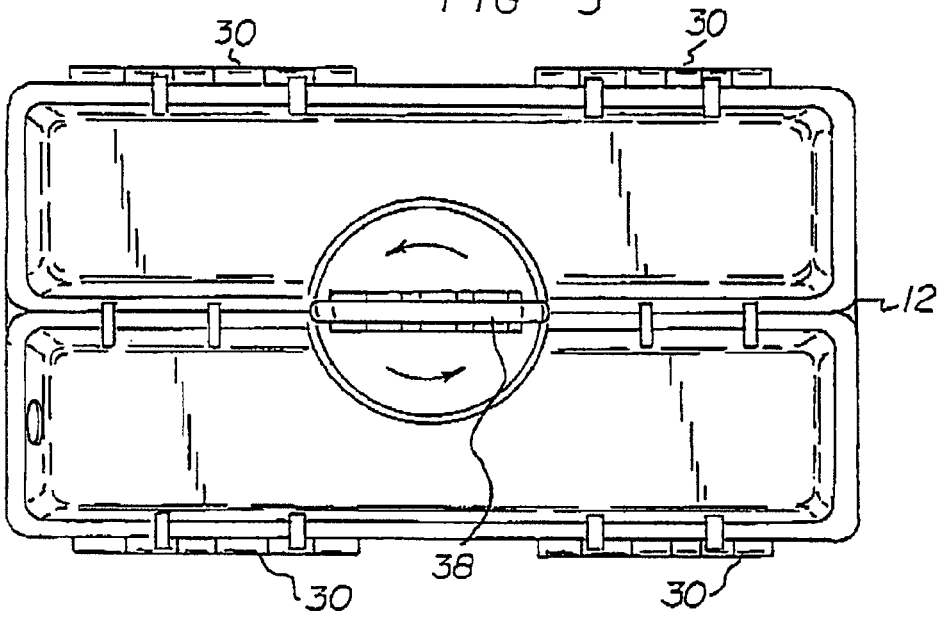
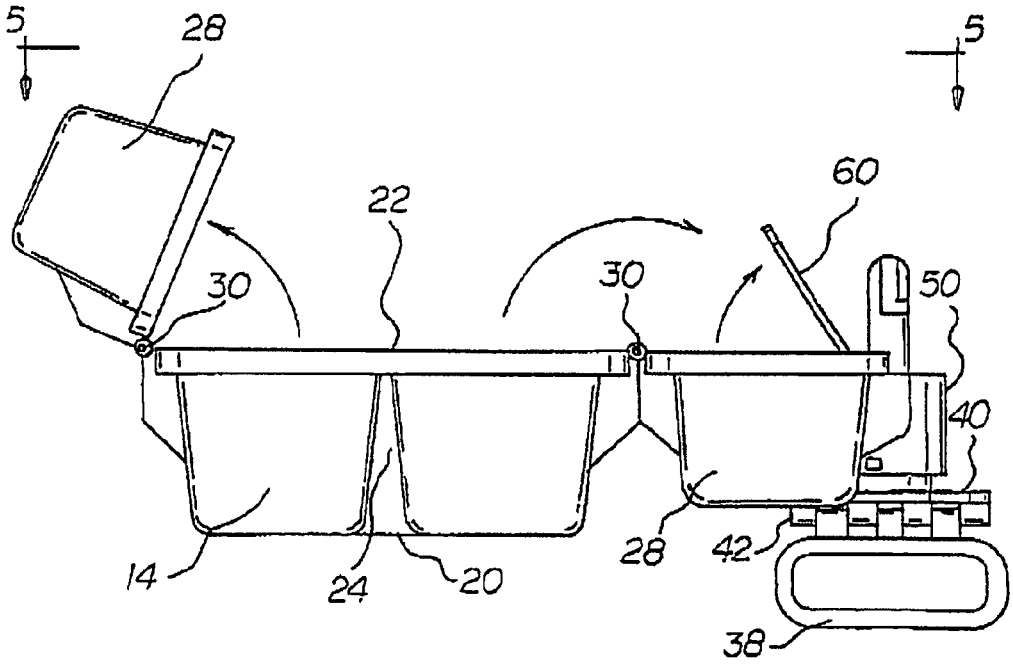
FIG 4

6
60
58
10
30
34
52
26
24
32
30
10
58
7
7
60
54B
54C
40

FIG 8
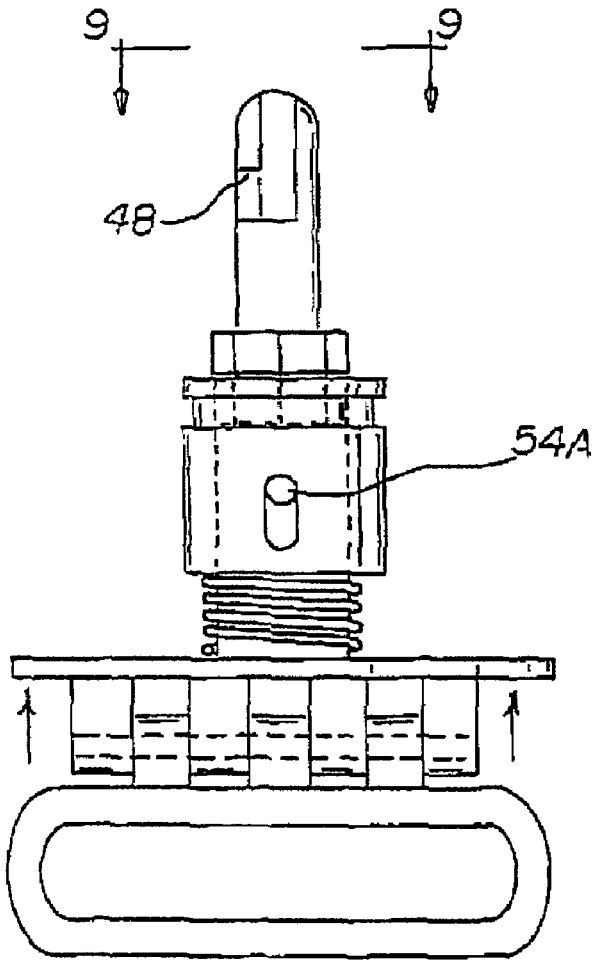
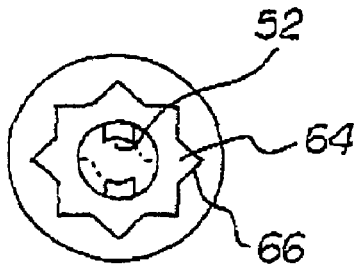
FIG 9

UTILITY CASE SYSTEM

BACKGROUND OF THE INVENTION

1. Field of the Invention

The present invention relates to a utility case system and more particularly pertains to receiving and supporting emergency medical components, fishing equipment, tools, electronic components and the like in a watertight, contaminate proof, secure and readily accessible manner.

2. Description of the Prior Art

The use of cases of known designs and configurations is known in the prior art. More specifically, cases of known designs and configurations previously devised and utilized for the purpose of storing and organizing components through known method and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,462,245 issued Jul. 17, 1923 relates to a tool or implement case. U.S. Pat. No. 1,502,987 issued Jul. 29, 1924 relates to a traveling bag. U.S. Pat. No. 2,697,539 issued Dec. 21, 1954 relates to a box with handle cover fastening means. U.S. Pat. No. 3,185,338 issued May 25, 1965 relates to a combination handle and latch for portable case. U.S. Pat. No. 3,459,327 issued Aug. 5, 1969 relates to a shell and accessory case for skeet. U.S. Pat. No. 3,747,796 issued Jul. 24, 1973 relates to a molded container. U.S. Pat. No. 3,933,296 issued Jan. 20, 1976 relates to packaging containers. U.S. Pat. No. 4,415,080 issued Nov. 15, 1983 relates to slitter blade carrying case. U.S. Pat. No. 5,035,321 issued Jul. 30, 1991 relates to a cleaning supplies caddy. U.S. Pat. No. 5,323,898 issued Jun. 28, 1994 relates to a dual hinged lid package. U.S. Pat. No. 6,736,265 issued May 18, 2004 relates to a general mechanic's toolbox. U.S. Pat. No. 6,533,138 issued Mar. 18, 2003 relates to a foldable tool kit. U.S. Design Pat. No. Des. 355,299 issued Feb. 14, 1995 relates to a compartmented carrying case. Lastly, U.S. Design Pat. No. Des. 488,928 issued Apr. 27, 2004 relates to an organizer case with multiple compartments.

While these devices fulfill their respective, particular objectives and requirements, the aforementioned patents do not describe a utility case system that allows receiving and supporting emergency medical components, fishing equipment, tools, electronic components and the like in a watertight, contaminate proof, secure and readily accessible manner.

In this respect, the utility case system according to the present invention substantially departs from the conventional concepts and designs of the prior art, and in doing so provides an apparatus primarily developed for the purpose of receiving and supporting emergency medical components, fishing equipment, tools, electronic components and the like in a watertight, contaminate proof, secure and readily accessible manner.

Therefore, it can be appreciated that there exists a continuing need for a new and improved utility case system which can be used for receiving and supporting emergency medical components, fishing equipment, tools, electronic components and the like in a watertight, contaminate proof, secure and readily accessible manner. In this regard, the present invention substantially fulfills this need.

SUMMARY OF THE INVENTION

In view of the foregoing disadvantages inherent in the known types of cases of known designs and configurations now present in the prior art, the present invention provides an improved utility case system. As such, the general purpose of the present invention, which will be described subsequently in greater detail, is to provide a new and improved utility case system and method which has all the advantages of the prior art and none of the disadvantages.

To attain this, the present invention essentially comprises a case. The case has a center support. The center support is formed with essentially vertical side walls and essentially vertical end walls. The vertical end walls are provided between the vertical side walls. The case has a horizontal bottom wall and an open top. The center support has a central wall intermediate the side walls. The central wall forms a first major chamber and a second major chamber. A central vertical aperture is provided. The case also has a pair of similarly configured butterfly doors. The butterfly doors form a first minor chamber and a second minor chamber. The case has a pair of hinges. The hinges couple the butterfly doors to the side walls adjacent to the open top. In this manner the butterfly doors may be pivoted between a closed orientation and an open orientation. In a closed orientation the first minor chamber is above the first major chamber and the second minor chamber is above the second major chamber. In an open orientation the first minor chamber is laterally spaced from the first major chamber and the second minor chamber is laterally spaced from the second major chamber.

A sealing assembly is provided. The sealing assembly is an injection molded, one piece seal formed of a first elastomeric sealing ring and a second elastomeric sealing ring, each with an inverted U-shaped configuration. The first and second sealing rings are joined together along an intermediate extent. An annular recess formed in the case at the top around the first major chamber receives and supports the first sealing ring. An annular recess formed in the case at the top around the second major chamber receives and supports the second sealing ring. A first recipient region is provided around the first minor chamber for contacting the first sealing ring when in the closed orientation. A second recipient region is provided around the second minor chamber for contacting the second sealing ring when in the closed orientation.

Provided next is a handle assembly. The handle assembly includes a handle and depending components. The depending components include a circular plate. The circular plate has an upper surface and hinge. The hinge pivotably couples the handle to the depending components. The depending components also include an upper exterior collar and an interior lower projection with keyways. The handle assembly also includes a recipient sleeve. The recipient sleeve is formed in one butterfly door. In this manner the handle and depending components may be supported. The handle assembly also includes female keys in the aperture of the center support. An associated pin and spring are provided. The handle is adapted to rotate the projection between a locked orientation and an unlocked orientation. In a locked orientation the keyways are in engagement with the keys of the aperture. In an unlocked orientation the keyways are out of engagement with the keys of the aperture.

Provided last is a plurality of walls. The plurality of walls includes dividers. The dividers are selectively positionable within the minor chambers essentially parallel with the end walls. The plurality of walls includes a lid. The lid is pivotably coupled to each butterfly door.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved utility case system which has all of the advantages of the prior art cases of known designs and configurations and none of the disadvantages.

It is another object of the present invention to provide a new and improved utility case system which may be easily and efficiently manufactured and marketed.

It is further object of the present invention to provide a new and improved utility case system which is of durable and reliable constructions.

An even further object of the present invention is to provide a new and improved utility case system which is susceptible of a low cost of manufacture with regard to both materials and labor, and which accordingly is then susceptible of low prices of sale to the consuming public, thereby making such utility case system economically available to the buying public.

Even still another object of the present invention is to provide a utility case system for receiving and supporting emergency medical components, fishing equipment, tools, electronic components and the like in a watertight, contaminate proof, secure and readily accessible manner.

Lastly, it is an object of the present invention to provide a new and improved utility case system. A case has a center support formed with side and end walls, a bottom wall and an open top. A central wall forms first and second major chambers with an aperture there between. The case has a pair of butterfly doors forming first and second minor chambers. A pair of hinges couple the butterfly doors to the side walls adjacent to the top. A sealing assembly is an injection molded, one piece seal formed of first and second sealing rings joined together along an intermediate extent. An annular recess is formed in the case at the open top around each major chamber. The recesses receive and support the sealing rings. A first and second recipient region is provided in the butterfly doors around the first and second minor chambers for contacting the sealing rings when the butterfly doors are in the closed orientation. A handle assembly has a handle and depending components. The depending components include a projection with keyways. A recipient sleeve supports the projection. The handle assembly has keys in the aperture of the center support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a watertight, contaminate proof utility case system constructed in accordance with the principles of the present invention.

FIG. 2 is a front elevational view of the system taken along line 2-2 of FIG. 1.

FIG. 3 is a plan view of the system taken along line 3-3 of FIG. 2.

FIG. 4 is a side elevational view similar to FIG. 1 but with the system in an open orientation.

FIG. 8 is a side elevational view of the handle assembly shown in FIG. 7.

FIG. 9 is a plan view of the handle assembly taken along line 9-9 of FIG. 8.

The same reference numerals refer to the same parts throughout the various Figures.

DESCRIPTION OF THE PREFERRED EMBODIMENT

Figure 5:
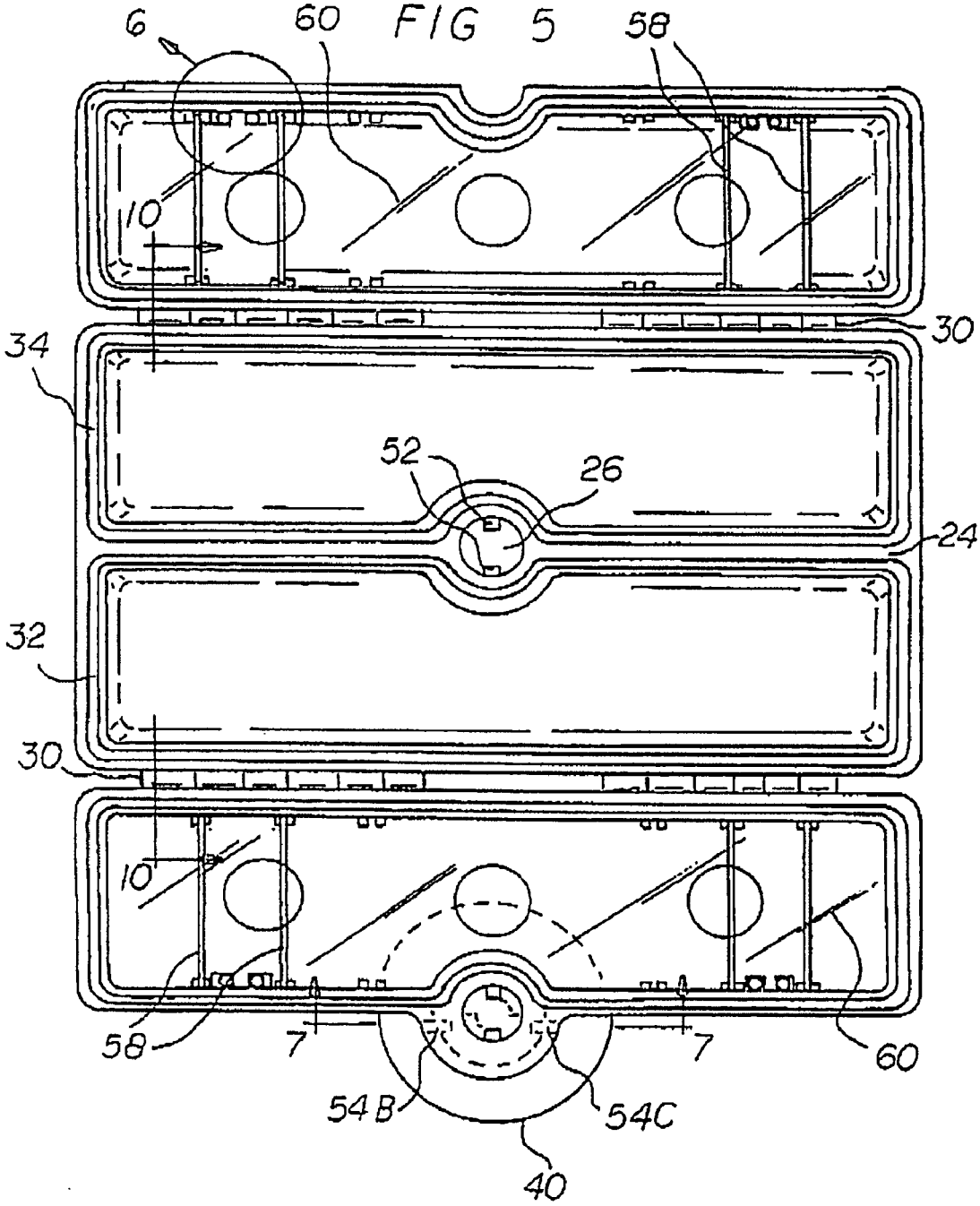
FIG. 5 is a plan view similar to FIG. 3 but with the system in a partially open orientation.

With reference now to the drawings, and in particular to FIG. 1 thereof, the preferred embodiment of the new and improved utility case system embodying the principles and concepts of the present invention and generally designated by the reference numeral 10 will be described.

The present invention, the utility case system 10 is comprised of a plurality of components. Such components in their broadest context include a case, a sealing assembly, and a handle assembly. Such components are individually configured and correlated with respect to each other so as to attain the desired objective.

First provided is a case 12. The case has a center support 14. The case is formed with essentially vertical side walls 16 and essentially vertical end walls 18. The vertical end walls are provided between the vertical side walls. The case has a horizontal bottom wall 20 and an open top 22. The center support 14 has a central wall 24 intermediate the side walls 16. The central wall forms a first major chamber and a second major chamber. A central vertical aperture 26 is provided. The case also has a pair of similarly configured butterfly doors 28.

The butterfly doors, like the central support, are formed with essentially vertical side walls and essentially vertical end walls. The vertical end walls are provided between the vertical side walls. The butterfly doors have a horizontal top wall and an open bottom. The butterfly doors form a first minor chamber and a second minor chamber. The butterfly doors have a pair of hinges 30. The hinges couple the butterfly doors 28 to the side walls 16 adjacent to the open top 22. In this manner the butterfly doors may be pivoted between a closed orientation and an open orientation. In a closed orientation the first minor chamber is above the first major chamber and the second minor chamber is above the second major chamber. In an open orientation the first minor chamber is laterally spaced from the first major chamber and the second minor chamber is laterally spaced from the second major chamber.

A sealing assembly is provided. The sealing assembly is an injection molded, one piece seal formed of a first elastomeric sealing ring 32 and a second elastomeric sealing ring 34, each in an inverted U-shaped configuration. The first and second sealing rings are joined together along an intermediate extent. An annular recess is formed in the case at the top around the first major chamber. This annular recess receives and supports the first sealing ring. An annular recess is also formed in the case at the top around the second major chamber. This annular recess receives and supports the second sealing ring. A first recipient region is provided around the first minor chamber for contacting the first sealing ring when in the closed orientation. A second recipient region is provided around the second minor chamber for receiving the second sealing ring when in the closed orientation.

The sealing assembly of the preferred embodiment of the present invention has been developed and provided by a specially designed thermal plastic injection molded elastomer that will create the seal between the butterfly doors and the major chambers. The elastomer is selected from the class of elastomers including plastic and rubber, natural and synthetic, and blends thereof. The seal is molded in a hollow form which will allow bonding both chemically and mechanically to the lower case adjacent to the major chambers. When the assembly is compressed by the butterfly doors it will create the desired seal to provide a watertight, contaminate proof and secure environment in the interior sections of the upper and lower case chambers when in the closed orientation.

The first and second sealing rings are preferably fabricated and employed as a unitary component coupled together in the region between the first and second major chambers to form a single component. A circular opening is formed centrally for the passage of the locking components.

Figure 7:
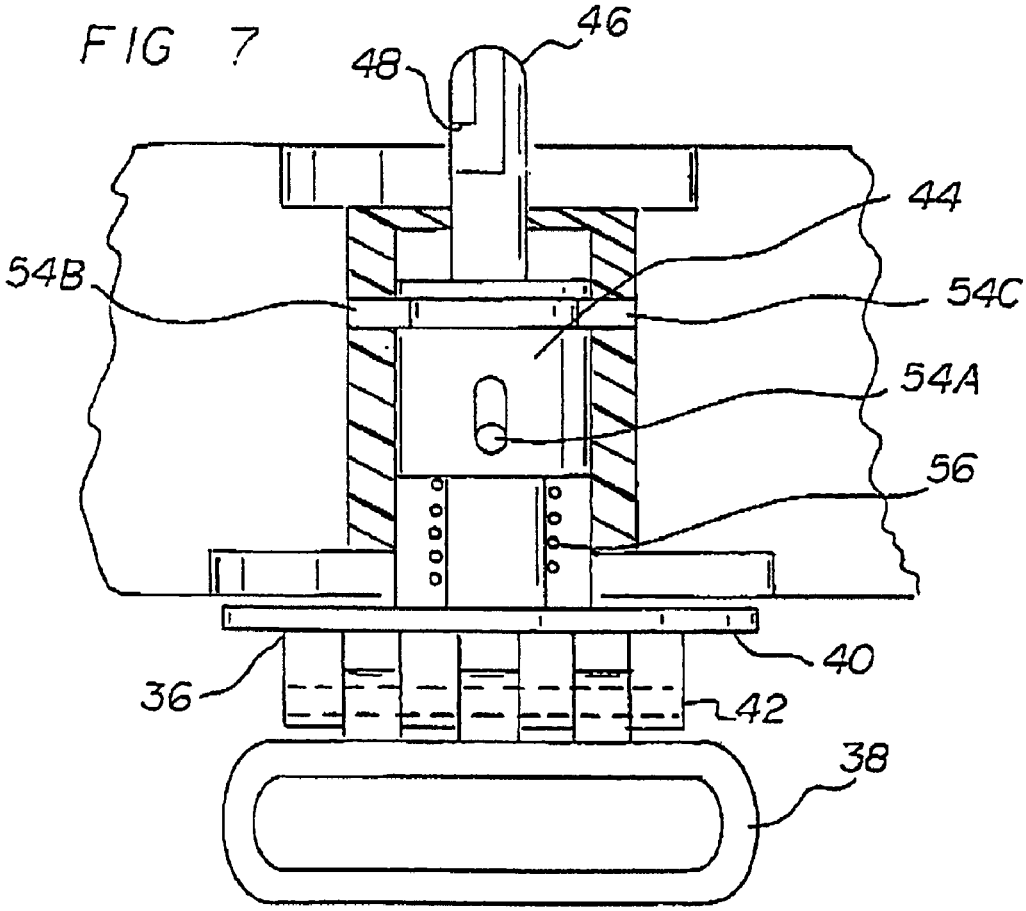
FIG. 7 is a cross-sectional view of the system taken at line 7-7 of FIG. 5.

Provided next is a handle assembly 36. The handle assembly includes a handle 38 and depending components. The depending components include a circular plate 40. The circular plate has an upper surface and hinge 42. The hinge pivotably couples the handle to the depending components. The depending components also include an upper exterior collar 44 and an interior lower projection 46 with keyways 48. The handle assembly also includes a recipient sleeve 50. The recipient sleeve is formed in one butterfly door. In this manner the handle and depending components may be supported. The handle assembly also includes female keys 52 in the aperture of the center support. An associated pin 54 and spring 56 are provided. The handle is adapted to rotate the projection between a locked orientation and an unlocked orientation. In a locked orientation the keyways are in engagement with the keys of the aperture. In an unlocked orientation the keyways are out of engagement with the keys of the aperture. The spring 56 functions to pull the keyways upwardly toward the keys and circular plate while functioning to pull the circular plate downwardly toward butterfly doors and the keys and keyways. The pin 54A functions to hold together the upper exterior collar 44 and an interior lower projection 46. Such pin is secured with respect to the interior lower projection and extends through an axial slot in the upper exterior collar. Note FIG. 7. Pins 54C and 54D secure the upper exterior collar with respect to the recipient sleeve 50.

Figure 10:
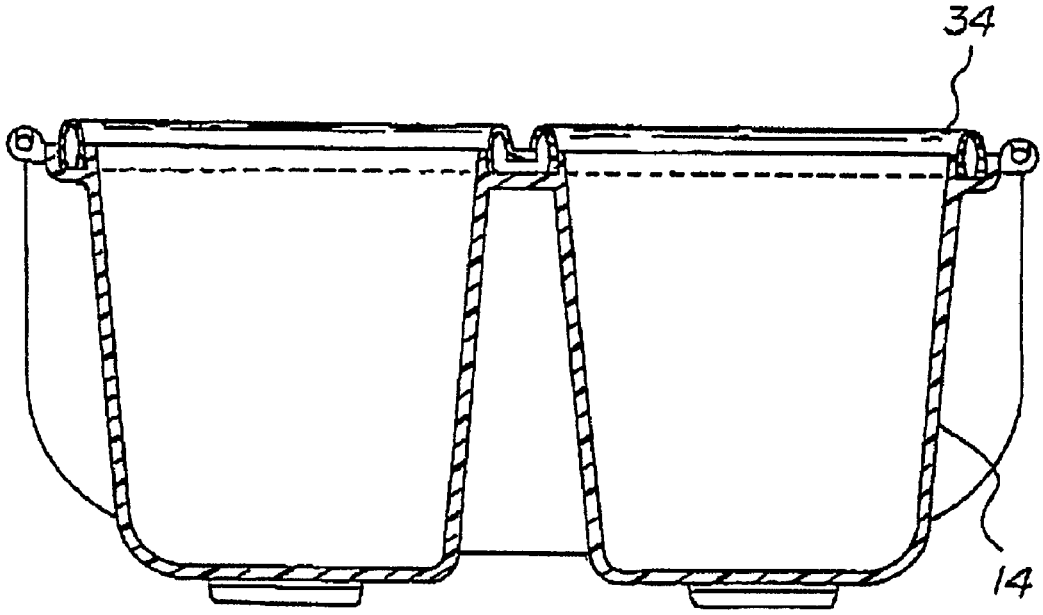
FIG. 10 is a cross-sectional view taken along line 10-19 of FIG. 5.

The sealing rings have an inverted U-shaped cross-sectional configuration and are positioned in a generally rectangular orientation as are the recipient regions around the minor chambers of the butterfly doors as well as the open top of the center support around the major chambers. Note FIG. 10. The sealing rings are oriented to include a semi-circular extent remote from the hinges to allow for the proper positioning of the components of the handle assembly. Note FIG. 2.

Figure 6:
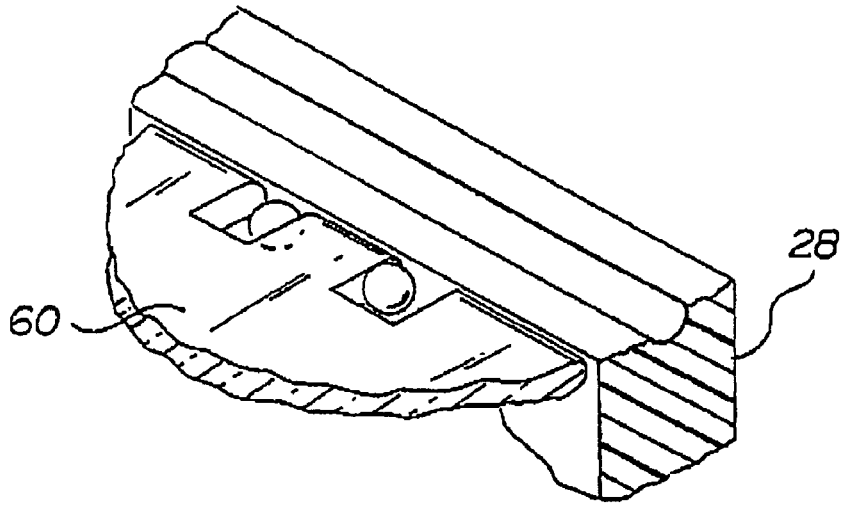
FIG. 6 is a perspective illustration taken at circle 6 of FIG. 5.

Further provided is a plurality of walls. The plurality of walls includes dividers 58. The dividers are selectively positionable within the minor chambers essentially parallel with the end walls. The plurality of walls includes a lid 60. The lid is pivotably coupled to each butterfly door with balls to assist in holding the lids in closed orientations until pulled open by a user. Note FIG. 6.

FIG. 9 illustrates a star like projection extending radially from the interior lower projection and received within a mating star like reception area. Such an arrangement precludes rotation of the interior lower projection when the system is closed until the handle is pressed to axially shift the star like projection away from the mating star like reception area in the aperture.

Provided last is a plurality of emergency medical components and the like which may be included with the case. The emergency medical components may, for example, include an inhaler kit. The inhaler kit would be provided in the first major chamber. The emergency medical components also may include a defibrillator. The defibrillator is provided in the second major chamber. Supplemental components are also provided. The supplemental components include bandages, tape, etc. The bandages and tape are provided within the minor chambers. Such components are for illustrative purposes only.

During operation and use, the utility case system of the present invention may be readily opened for use by pushing downwardly on the handle to separate and disengage the keyways from the keys. Such pushing down is next followed by then rotating the handle, ninety degrees in the preferred embodiment. This thus allows axial movement of the keyways with respect to the keys. This in turn allows pivoting of the butterfly doors from the closed orientation shown in FIG. 1 to the open orientation of FIG. 2. This efficient quarter-turn handle/locking mechanism provides quick one-handed access to all of the contents of the utility case system. This saves precious seconds in emergency situations. Since the hand of the carrier is already positioned on the handle, access time is further reduced by the one continuous motion of setting the box down and opening it. The transparent lids covering the secondary chambers of the butterfly doors enable full view of the contents of the utility case system within storage space in the center support as well as within the two butterfly doors.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

It is noted that an alternative embodiment of the present invention provides a molded sealing assembly, formed of a first elastomeric sealing ring and a second elastomeric sealing ring. Annular recesses are formed in the butterfly doors that receive and support the sealing rings. Recipient recesses are provided around the first and second major chambers for receiving the sealing rings when in the closed orientation.

What is claimed as being new and desired to be protected by Letters Patent of the United States is as follows:

1. A utility case system comprising:

a case having a center support formed with side and end walls and a bottom wall and an open top, and with a central wall forming a first and second major chambers with a central vertical aperture therein, the case also having a pair of similarly configured butterfly doors forming first and second minor chambers and a pair of hinges coupling the butterfly doors to the side walls adjacent to the open top;

a sealing assembly is an injection molded, one piece seal joined together along first an intermediate extent formed of first and second sealing rings with an annular recess formed in the case at the open top around the major chambers receiving and supporting the sealing rings, and with a first and second recipient region in the butterfly doors around the first and second minor chambers for contacting the sealing rings when the butterfly doors are in the closed orientation; and a handle assembly including a handle and depending components including a projection with keyways, and a recipient sleeve supporting the projection, the handle assembly also including keys in the aperture of the center support.

2. The system as set forth in claim 1 and further comprising a plurality of walls including dividers selectively positionable within the minor chambers essentially parallel with the end walls and a lid pivotably coupled to each butterfly door.

3. A utility case system for receiving and supporting emergency medical components and the like in a watertight, contaminate proof, secure and readily accessible manner, comprising, in combination:

a case having a center support formed with essentially vertical side walls and essentially vertical end walls there between and a horizontal bottom wall and an open top, the center support having a central wall intermediate the side walls forming a first major chamber and a second major chamber with a central vertical aperture, the case also having a pair of similarly configured butterfly doors forming a first minor chamber and a second minor chamber and a pair of hinges coupling the butterfly doors to the side walls adjacent to the open top whereby the butterfly doors maybe pivoted between a closed orientation with the first minor chamber above the first major chamber and the second minor chamber above the second major chamber and open orientation with the first minor chamber laterally spaced from the first major chamber and the second minor chamber laterally spaced from the second major chamber;

a sealing assembly is an injection molded, one piece seal formed of a first elastomeric sealing ring in an inverted U-shaped configuration and an annular recess formed in the case at the top around the first major chamber receiving and supporting the first sealing ring, and a second elastomeric sealing ring in an inverted U-shaped configuration and an annular recess formed in the case at the top around the second major chamber receiving and supporting the second sealing ring with a first recipient recess around the first minor chamber for receiving the first sealing ring when in the closed orientation, and a second recipient region around the second minor chamber for receiving the second sealing ring when in the closed orientation, the first and second sealing rings being joined together along an intermediate extent;

a handle assembly including a handle and depending components including a circular plate with an upper surface and hinge for pivotably coupling the handle to the depending components, the depending components also including an upper exterior collar and an interior lower projection with keyways, the handle assembly also including a recipient sleeve formed in one butterfly door for rotatably supporting the handle and depending components, the handle assembly also including female keys in the aperture of the center support with an associated pin and spring whereby the handle is adapted to rotate the projection between a locked orientation with the keyways in engagement with the keys of the aperture and an unlocked orientation wherein the keyways are out of engagement with the keys of the aperture; and a plurality of walls including dividers selectively positionable within the minor chambers essentially parallel with the end walls and a lid pivotably coupled to each butterfly door.

* * * * *